United States Patent [19]

Ibusuki et al.

[11] Patent Number: 4,897,772

[45] Date of Patent: Jan. 30, 1990

[54] DENTAL ASTRAL LAMP

[75] Inventors: Masumi Ibusuki, Yokosuka; Hidehito Ishikawa, Tokyo, both of Japan

[73] Assignee: G-C Dental Industrial Corp., Tokyo, Japan

[21] Appl. No.: 289,250

[22] Filed: Dec. 23, 1988

[30] Foreign Application Priority Data

Dec. 25, 1987 [JP] Japan ..... 62-195844[U]

[51] Int. Cl.[4] ..... F21V 9/00

[52] U.S. Cl. ..... 362/282; 362/293; 362/322; 362/449; 362/804

[58] Field of Search ..... 362/804, 293, 277, 282, 362/319, 322, 433, 449

[56] References Cited

U.S. PATENT DOCUMENTS

| | | | |
|---|---|---|---|
| 2,614,783 | 10/1952 | Spear | 362/281 |
| 3,588,488 | 6/1971 | Lauterbach | 362/804 |
| 3,704,928 | 12/1972 | Coombs et al. | 362/804 |
| 4,516,195 | 5/1985 | Gonser | 362/804 |
| 4,653,925 | 3/1987 | Thornton, Jr. | 356/419 |

FOREIGN PATENT DOCUMENTS

| | | | |
|---|---|---|---|
| 78067 | 8/1954 | Denmark | 362/804 |

*Primary Examiner*—Stephen F. Husar
*Assistant Examiner*—Richard R. Cole
*Attorney, Agent, or Firm*—Oblon, Spivak, McClelland, Maier & Neustadt

[57] ABSTRACT

A dental astral lamp using a tungsten halogen lamp as a light source is detachably provided on its light emanating plane with a color temperature transducing filter serving to reduce a luminous intensity at its focal position to a range of 1,500 to 4,500 luxes and transduce a color temperature to a range of 5,000 to 7,500 kelvins.

3 Claims, 2 Drawing Sheets

DENTAL ASTRAL LAMP

BACKGROUND OF THE INVENTION

1. Field of the Invention

The present invention relates to a dental astral lamp which is an accessory of dental treating equipment and can make an appropriate compromise between opposite demands i.e., a luminous intensity so high for usual dental treatments that it can make it easy for a dentist to carry out precise manipulations for cutting the teeth of a patient and a combination of a color temperature with a low luminous intensity which can make it easy for a dentist to select artificial teeth and fillers in good agreement with the color of the teeth of a patient.

2. Statement of the Prior Art

In general, cutting of decayed teeth of a patient and filling of a filler into a decayed portion constitute a major part in dental treatments. Thus, a light source of a considerably strong luminous intensity is needed to carry out such treatments, since the portion to be treated is of a very small area. For that reason usually employed to this end is a dental astral lamp using a tungsten halogen lamp as its light source.

Such a dental astral lamp using a tungsten halogen lamp as its light source has conventionally a luminous intensity of the order of 15,000 to 25,000 luxes and a color temperature of the order of 3,000 to 4,500 kelvins at the focal position.

With the recent remarkable developments in dental treatments, however, the range of treatments have now covered from artificial teeth such as full dentures, partial dentures, bridges or post crowns, treatments for the bonding and fixation of prostheses such as jacket crowns. Not only for such dental treatments but also in the filling of fillers such as composite resins in decayed portions of natural teeth, it has been required to select a material of a color tone well matching with a patient.

In such color matching between natural teeth and artifical teeth, etc., there is a difference in spectral reflectance that is one of the physical characteristics with respect to light due to their differences in material and structure. There is also a difference in spectral energy distribution among general illumination light sources available in zones of life such as sunrays, incandescent lamps and fluorescent lamps. For those reasons, the results of color matching of natural teeth with artificial teeth, etc. vary depending upon what type of light is used for color matching between natural and artificial teeth etc. due to a difference in spectral energy distribution which these light sources have. In other words, the color tone of artificial teeth, etc. subjected to color matching in the light of a white fluorescent lamp or an incandescent lamp gives rise to a color shift larger than tolerance in the light of other fluorescent lamps or sunrays, which is known as the so-called metamerism in chromatics.

In general, the light source used as a reference in the observation of a color should be indirect incident rays of the sun through a northward window during a period of from two hours after sunrise to two hours before sundown. Weather conditions, sites where treatments are carried out, treating time or other factors, however, will not always guarantee sunrays on fine day. As a result, it is often required that color matching be carried out in the light of an artificial light source.

In view of chromatic agreement, it has recently been established that an artificial illuminator having any one color temperature of 5,500 kelvins, 6,500 kelvins and 7,500 kelvins corresponding to daylight be used as a standard illuminator. However, the color temperature of the tungsten halogen lamp used as a light source for white fluorescent lamps for indoor illumination or dental astral lamps built in dental units is of the order of 3,000 to 4,500 luxes as mentioned above, and it is largely different from that of sunrays and is thus low in color rendering properties. Thus, the development of an illuminator to replace sunrays has been desired.

A conventional dental astral lamp using a tungsten halogen lamp as its light source has a luminous intensity of 15,000 to 25,000 luxes at its focal position so as to meet an illumination condition under which precise manipulations such as cutting of teeth can be carried out. However, such a luminous intensity is too strong and therefore not preferred, since the luminous intensity of an illuminator for colorimetry of artificial teeth, etc. is considered to be satisfactory at 2,000 to 3,000 luxes as a reference light source where eyes are adapted to ordinary indoor lightness.

In consequence, it is required for dental treatments that use be made of not only a luminous intensity so strong that precise manipulations such as cutting of teeth can be carried out but also a combination of a luminous intensity of 1,500 to 4,500 luxes and a color temperature of 5,000 to 7,500 kelvins for color matching. However, the treatment needing color matching is still a minor part the overall dental treatment process, and there is often no space for the installation of another light source in relation to the size of a treatment room.

SUMMARY OF THE INVENTION

As a result of intensive studies made to solve such problems of the prior art, it has been found that they are solved by using a conventional dental astral lamp having a strong luminous intensity and using a tungsten halogen lamp as a light source so as to carry out precise manipulations such as cutting of teeth and attaching to a light emanating plane of said dental astral lamp a color temperature transducing filter serving to reduce the luminous intensity at its focal position to a predetermined value and transduce the color temperature to a predetermined value.

More specifically, the present invention provides a dental astral lamp using a tungsten halogen lamp as a light source, which is detachably provided at its light emanating plane with a color temperature transducing filter serving to reduce the luminous intensity at its focal position to a range of 1,500 to 4,500 luxes and transduce the color temperature to a range of 5,000 to 7,500 kelvins.

The dental astral lamp according to the present invention will now be explained in more detail with reference to the drawings.

EXPLANATION OF THE PREFERRED EMBODIMENTS

Figure 1:
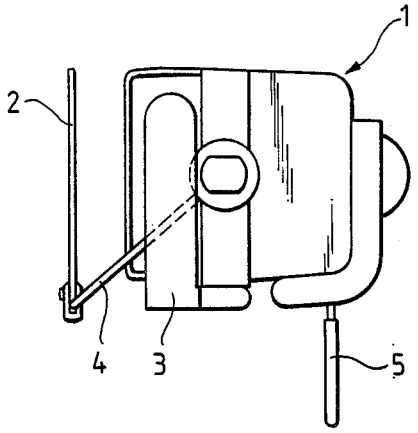
FIG. 1 is a side view of one embodiment of the dental astral lamp according to the present invention in which a color temperature transducing filter is attached to a light emanating plane.

Referring to the drawings, reference numeral 1 stands for a dental astral lamp body using a tungsten halogen lamp as a light source. Reference numeral 2 stands for a color temperature transducing filter to be detachably attached to a light emanating plane of the dental astral lamp body 1. Upon being attached to the light emanating plane, the color temperature transducing filter serves to reduce the luminous intensity of the dental astral lamp body 1 at its focal position to a range of 1,500 to 4,500 luxes and transduce the color temperature thereof to a range of 5,000 to 7,500 kelvins.

Figure 2:
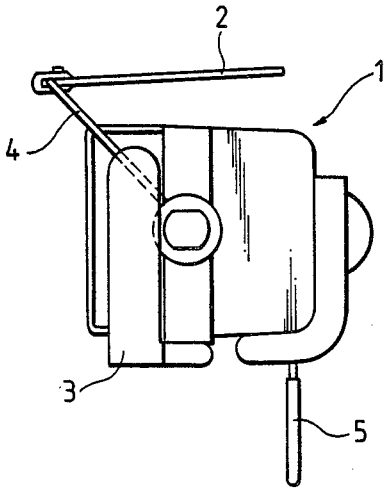
FIG. 2 is a side view of the dental astral lamp of FIG. 1 in which the color temperature transducing filter is removed from the light emanating plane.

The transducing filter 2 may be formed of either a single-layer transducing filter or a laminated transducing filter of two or more layers so as to reduce the luminous intensity to the aforesaid predetermined range. An arm 3 is fixed on both sides of the dental astral lamp body 1 to displace the lamp body 1 to a given position. A mounting bracket 4 is mounted on the dental astral lamp body 1 to detachably attach the transducing filter 2 to the light emanating plane of the dental astral lamp body 1. The mounting bracket 4 may be a U-shaped arm turntable at each end around a corresponding support point provided on the lamp body 1 so that the transducing filter 2 can be turned around the support point and positioned on the light emanating plane of the dental astral lamp body 1 (i.e., the embodiment of FIGS. 1–3), a vertically displaceable guide provided on both sides of the front face of the dental astral lamp body 1 so that the transducing filter 2 can be vertically displaced therealong and moved down and positioned on the light emanating plane of the dental astral lamp body 1 (i.e., the embodiment of FIG. 4), or of any other arrangements. It is here understood that reference numeral 5 stands for a switch for putting on or off the tungsten halogen lamp used as the light source of the lamp body 1.

As detailed above, the dental astral lamp according to the present invention is of the structure that the tungsten halogen lamp is used as the light source, and it is detachably provided on its light emanating plane with the color temperature transducing filter serving to reduce the luminous intensity at its focal position to the range of 1,500 to 4,500 luxes and the color temperature to the range of 5,000 to 7,500 kelvins. When ordinary precise manipulations such as cutting of teeth are carried out, the color temperature transducing filter may be spaced away from the light emanating plane of the dental astral lamp in such a manner that the luminous intensity at the focal position is regulated to a range of 15,000 to 25,000 luxes so as to meet the illumination condition suitable for such precise manipulations.

Further, when it is required to select a material of a color tone well matching with a patient for treatments with artificial teeth such as full dentures, partial dentures, bridges or post crowns, treatments for the bonding and fixation of prostheses such as jacket crowns or treatments for filling a filler such as a composite resin in decayed portions of natural teeth, the color temperature transducing filter may be positioned on the light emanating plane of the dental astral lamp to transduce as a reference light source the light emanating from that lamp to a light having a luminous intensity of 1,500 to 4,500 luxes and a color temperature of 5,000 to 7,500 kelvins, both most suitable as the light source of colorimetry of artificial teeth, etc. Still further, since the attachment and detachment of the transducing filter to and from the light emanating plane of the dental astral lamp are easily achieved by the guide member, it is possible to use the dental astral lamp as the sole light source for both conventional precise manipulations such as ordinary cutting of teeth and color matching of artificial teeth. In addition, the dental astral lamp according to the present invention is easy to manufacture since the color temperature transducing filter for reducing the luminous intensity of the dental astral lamp at its focal position to the range of 1,500 to 4,500 luxes and the color temperature to the range of 5,000 to 7,500 kelvins is available at relatively low prices. Thus, the dental astral lamp of the present invention is of practically great value.

EXAMPLE

Figure 3:
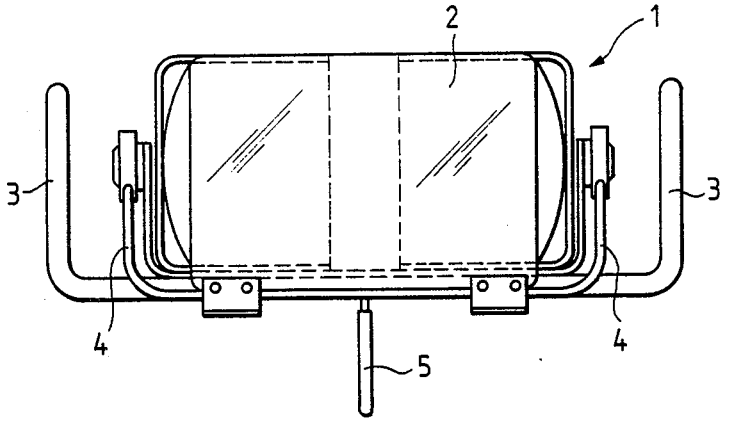
FIG. 3 is a front view of FIG. 1.
Figure 4:
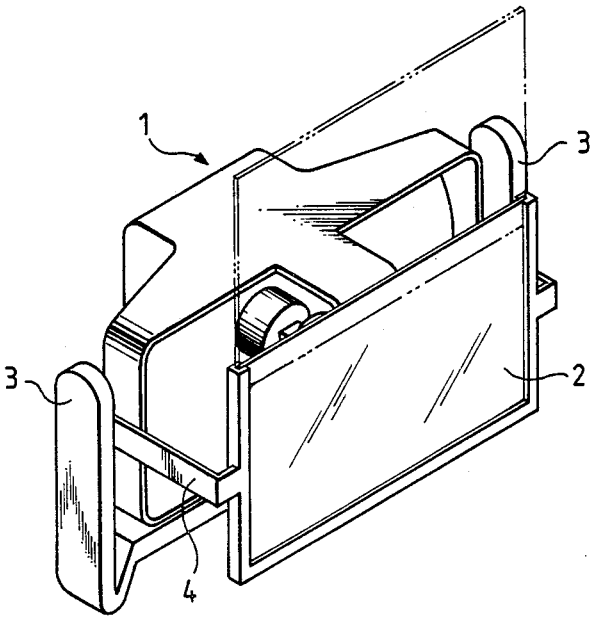
FIG. 4 is a perspective view of the dental astral lamp according to the present invention in which a color temperature transducing filter is moved down and positioned on a light emanating place by means of a vertically displaceable guide located on both sides of the front face thereof.

A light-blue color temperature transducing filter manufactured by Hoya Co., Ltd. was attached to and positioned, as illustrated by FIG. 3, on the light emanating plane of a dental astral lamp manufactured by G-C Dental Industrial Corp. (Trade Name: G-C Elan EL-2,000, AC12V, 55W, a maximum intensity at the focal position: 22,000 luxes, a color temperature: 3,700 kelvins, and a focal distance: 65 cm). As a result, it was found that, since the luminous intensity at the focal position of the dental astral lamp was reduced to 4,000 luxes and the color temperature was transduced to 6,000 kelvins, good color matching was achieved for the selection of any one of artificial teeth, jacket crowns and composite resins regardless of day and night. In addition, where this color temperature transducing filter was spaced away from the light emanating plane of the dental astral lamp, precise manipulations such as cutting of teeth could be carried out without difficulty.

What is claimed is:

1. A dental astral lamp comprising:

(a) a lamp body, said lamp body being generally rectangular parallelepipedal in shape and having two sides, a front, and a top;

(b) a tungsten halogen lamp contained in said lamp body in position to project light through the front of said lamp body, said tungsten halogen lamp having a luminous intensity of between 15,000 luxes and 15,000 luxes and a color temperature of between 3,000 kelvins and 4,500 kelvins at its focal position;

(c) a U-shaped mounting bracket pivotally mounted at each end on a corresponding side of said lamp body and pivotable through an angle of at least approximately 90° between a first position and a second position; and (d) a color temperature transducing filter mounted on said U-shaped mounting bracket such that, when said U-shaped mounting bracket is in its first position, said color temperature transducer filter is parallel to and spaced from said lamp body in front of said tungsten halogen lamp and, when said U-shaped mounting bracket is in its second position, said color temperature transducing filter is parallel to and spaced from the top of said lamp body, said color temperature transducing filter serving when said U-shaped mounting bracket is in its first position to reduce the luminous intensity at the focal position of said tungsten halogen lamp to between 1,500 luxes and 4,500 luxes and the color temperature at the focal position of said tungsten halogen lamp to between 5,000 kelvins and 7,500 kelvins.

2. A dental astral lamp as claimed in claim 1, wherein said color temperature transducing filter comprises a single-layer color temperature transducing filter.

3. A dental astral lamp as claimed in claim 1, wherein said color temperature transducing filter comprises a laminated transducing filter of two or more layers.

* * * * *